US006039633A

United States Patent [19]

Chopra

[11] Patent Number: 6,039,633

[45] Date of Patent: Mar. 21, 2000

[54] METHOD AND APPARATUS FOR MECHANICAL AND CHEMICAL-MECHANICAL PLANARIZATION OF MICROELECTRONIC-DEVICE SUBSTRATE ASSEMBLIES

[75] Inventor: Dinesh Chopra, Boise, Id.

[73] Assignee: Micron Technology, Inc., Boise, Id.

[21] Appl. No.: 09/164,916

[22] Filed: Oct. 1, 1998

[51] Int. Cl.[7] ..... B24B 1/00

[52] U.S. Cl. ..... 451/41; 451/526; 451/528; 451/548; 451/60; 451/173

[58] Field of Search ..... 451/41, 921, 526–539, 451/173, 60, 548, 550

[56] References Cited

U.S. PATENT DOCUMENTS

| | | | |
|---|---|---|---|
| 4,576,612 | 3/1986 | Shukla et al. | 451/921 |
| 4,733,502 | 3/1988 | Braun | 451/41 |
| 5,692,950 | 12/1997 | Rutherford et al. | 451/552 |
| 5,722,877 | 3/1998 | Meyer et al. | 451/41 |
| 5,727,989 | 3/1998 | Ohno et al. | 451/41 |
| 5,733,176 | 3/1998 | Robinson et al. | 451/41 |

*Primary Examiner*—Robert A. Rose
*Assistant Examiner*—George Nguyen
*Attorney, Agent, or Firm*—Dorsey & Whitney LLP

[57] ABSTRACT

A plurality of polishing pads and methods for mechanical and/or chemical-mechanical planarization of substrate assemblies with the polishing pads in the fabrication of microelectronic devices. In one embodiment, a polishing pad has a suspension medium with an exposed surface configured to face toward a substrate holder of a planarizing machine, and a plurality of reaction control elements in the suspension medium. The reaction control elements are bonded to the suspension medium in a fixed distribution across at least a portion of the exposed surface of the suspension medium to define at least a portion of a planarizing surface of the polishing pad. The reaction control elements are preferably soluble in the planarizing fluid to impart a chemical to the planarizing fluid that interacts with the substrate assembly for controlling removal of material from the substrate assembly. For example, the reaction control elements are generally oxidants, inhibitors, wetting agents, surfactants and/or other chemicals that are typically a component of the planarizing fluid before the planarizing fluid is deposited onto the planarizing surface. In a preferred embodiment, the polishing pad further includes a plurality of abrasive particles fixedly attached to the suspension medium in addition to the reaction control elements.

81 Claims, 6 Drawing Sheets

METHOD AND APPARATUS FOR MECHANICAL AND CHEMICAL-MECHANICAL PLANARIZATION OF MICROELECTRONIC-DEVICE SUBSTRATE ASSEMBLIES

TECHNICAL FIELD

The present invention relates to pads for planarizing microelectronic-device substrate assemblies in mechanical and chemical-mechanical planarizing processes.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic-device substrate assemblies. FIG. 1 schematically illustrates a planarizing machine 10 with a platen or table 20, a carrier assembly 30, a polishing pad 40 positioned on the table 20, and a planarizing fluid 44 on the polishing pad 40. The planarizing machine 10 may also have an under-pad 25 attached to an upper surface 22 of the platen 20 for supporting the polishing pad 40. In many planarizing machines, a drive assembly 26 rotates (arrow A) and/or reciprocates (arrow B) the platen 20 to move the polishing pad 40 during planarization.

The carrier assembly 30 controls and protects a substrate 12 during planarization. The carrier assembly 30 typically has a substrate holder 32 with a pad 34 that holds the substrate 12 via suction. A drive assembly 36 of the carrier assembly 30 typically rotates and/or translates the substrate holder 32 (arrows C and D, respectively). The substrate holder 32, however, may be a weighted, free-floating disk (not shown) that slides over the polishing pad 40.

The combination of the polishing pad 40 and the planarizing fluid 44 generally define a planarizing medium that mechanically and/or chemically-mechanically removes material from the surface of the substrate 12. The polishing pad 40 may be a conventional polishing pad composed of a polymeric material (e.g., polyurethane) without abrasive particles, or it may be an abrasive polishing pad with abrasive particles fixedly bonded to a suspension material. In a typical application, the planarizing fluid 44 may be a CMP slurry with abrasive particles and chemicals for use with a conventional nonabrasive polishing pad. In other applications, the planarizing fluid 44 may be a chemical solution without abrasive particles for use with an abrasive polishing pad.

To planarize the substrate 12 with the planarizing machine 10, the carrier assembly 30 presses the substrate 12 against a planarizing surface 42 of the polishing pad 40 in the presence of the planarizing fluid 44. The platen 20 and/or the substrate holder 32 then move relative to one another to translate the substrate 12 across the planarizing surface 42. As a result, the abrasive particles and/or the chemicals in the planarizing medium remove material from the surface of the substrate 12.

CMP processes should consistently and accurately produce a uniformly planar surface on the substrate to enable precise fabrication of circuits and photo-patterns. During the fabrication of transistors, contacts, interconnects and other features, many substrates develop large "step heights" that create a highly topographic surface across the substrate. Yet, as the density of integrated circuits increases, it is necessary to have a planar substrate surface at several stages of processing the substrate because non-uniform substrate surfaces significantly increase the difficulty of forming sub-micron features. For example, it is difficult to accurately focus photo-patterns to within tolerances approaching 0.1 μm on non-uniform substrate surfaces because sub-micron photolithographic equipment generally has a very limited depth of field. Thus, CMP processes are often used to transform a topographical substrate surface into a highly uniform, planar substrate surface.

In the competitive semiconductor industry, it is also highly desirable to have a high yield in CMP processes by producing a uniformly planar surface at a desired endpoint on a substrate assembly as quickly as possible. For example, when a conductive layer on a substrate is under-planarized in the formation of contacts or interconnects, many of these components may not be electrically isolated from one another because undesirable portions of the conductive layer may remain on the substrate over a dielectric layer. Additionally, when a substrate is over planarized, components below the desired endpoint may be damaged or completely destroyed. Thus, to provide a high yield of operable microelectronic devices, CMP processing should quickly remove material until the desired endpoint is reached.

The planarity of the finished substrates and the yield of CMP processing is a function of several factors, one of which is the rate at which material is removed from the substrate assembly (the "polishing rate"). Although it is desirable to have a high polishing rate to reduce the duration of each planarizing cycle, the polishing rate should be uniform across the substrate to produce a uniformly planar surface. The polishing rate should also be consistent to accurately endpoint CMP processing at a desired elevation in the substrate assembly. The polishing rate, therefore, should be controlled to provide accurate, reproducible results.

In conventional CMP processes, the polishing rate may not be uniform across the substrate assembly or consistent from one planarizing cycle to another. The polishing rate itself is influenced by several factors. One factor that influences the polishing rate is the distribution of planarizing fluid 44 between the substrate assembly 12 and the planarizing surface of the polishing pad 40. The distribution of the planarizing fluid 44 may not be uniform across the surface of the substrate assembly 12 because the leading edge of the substrate assembly 12 relative to the motion between the substrate assembly 12 and the planarizing surface 42 wipes a significant portion of the planarizing fluid 44 off of the polishing pad 40 before the planarizing fluid 44 can contact the other areas of the substrate assembly. The non-uniform distribution of planarizing fluid 44 under the substrate 12 can cause certain areas of the substrate assembly 12 to have a higher polishing rate than other areas because they have more contact with the chemicals and/or abrasive particles in the planarizing fluid. The surface of the substrate assembly 12 may accordingly not be uniformly planar, and in extreme cases, some devices may be damaged or destroyed by CMP processing.

The polishing rate may also vary from one substrate assembly to another, or even across a particular substrate, because the composition of the planarizing fluid 44 may vary. The chemicals added to the planarizing fluid 44 may degrade over time causing one batch of planarizing fluid 44 to have a different polishing rate than another batch of planarizing fluid 44. Additionally, many components in the planarizing fluid 44 settle in a liquid solution, and thus the concentration of chemicals of a particular batch of planarizing fluid 44 may also vary. As a result of the changes in the composition of the planarizing fluid 44, the polishing rate of a particular substrate assembly 12 may change making it difficult to uniformly planarize the substrate assembly 12 and to stop the planarization at a desired endpoint.

One technique for controlling the polishing rate to more uniformly remove material from the substrate assemblies is to provide better "transportation" of the planarizing fluid under the substrate assemblies. For example, the polishing pad may have grooves or wells to hold some of the planarizing solution under the substrate assemblies. In other applications, the planarizing fluid is pumped through the pad. Although providing transportation of the planarizing fluid enhances the distribution of the planarizing fluid under substrate and produces a more uniform polishing rate, many CMP applications still suffer from non-uniform and inconsistent polishing rates because of the variations in the composition of the planarizing fluid itself from one batch of fluid to another. Thus, CMP processing may not provide sufficiently planar surfaces or an adequate yield of operable devices.

SUMMARY OF THE INVENTION

The present invention is directed toward polishing pads, planarizing machines with the polishing pads, and methods for mechanical and/or chemical-mechanical planarization of substrate assemblies with the polishing pads in the fabrication of microelectronic devices. In one aspect of the invention, a polishing pad has a suspension medium with an exposed surface configured to face toward a substrate holder of a planarizing machine, and a plurality of reaction control elements in the suspension medium. The reaction control elements are bonded to the suspension medium in a fixed distribution across at least a portion of the exposed surface of the suspension medium to define at least a portion of a planarizing surface of the polishing pad. The reaction control elements are preferably soluble in the planarizing fluid to impart a chemical action to the planarizing fluid that interacts with the substrate assembly for controlling removal of material from the substrate assembly. For example, the reaction control elements are generally oxidants, inhibitors, wetting agents, surfactants, thickeners, buffering agents and/or other chemicals. The polishing pad preferably includes a plurality of abrasive particles fixedly attached to the suspension medium in addition to the reaction control elements.

The suspension medium and the reaction control elements define a planarizing control member that can be attached to a pad body composed of polyurethane or other suitable materials. The planarizing control member, for example, can cover the pad body such that the exposed surface of the planarizing control member defines the planarizing surface of the polishing pad. Alternatively, the planarizing control member can be embedded into the pad body such that the exposed surface of the planarizing control member and a front surface of the pad body together define the planarizing surface of the polishing pad. The planarizing control member can also be attached directly to a backing film without the pad body, or the planarizing control member can be a free standing structure that is coupled to the table of the planarizing machine without either the pad body or the backing film.

The pad can also have a patterned planarizing surface. For example, the planarizing control member can have a plurality of wells, or the planarizing control member can have a plurality of raised features. Such raised features can be formed by embossing a surface pattern onto the planarizing control member to create raised features or planarizing structures (e.g., small towers) across the pad. The raised features can accordingly include reaction control elements and abrasive particles distributed within a suspension medium to define the planarizing surface.

In a preferred operation of the polishing pad, at least a portion of the reaction control elements dissolves into the planarizing fluid deposited onto the planarizing surface of the polishing pad. The dissolved portion of the reaction control elements interacts with the substrate assembly to enhance or otherwise control the removal of material from the substrate assembly. In the planarization of a metal cover layer from the substrate assembly, for example, an oxidant fixedly distributed in the suspension medium of the polishing pad dissolves into the planarizing fluid to oxidize the surface of the metal cover layer.

DETAILED DESCRIPTION OF THE INVENTION

The present disclosure describes apparatus and methods for mechanical and/or chemical-mechanical planarization of substrate assemblies used in the fabrication of microelectronic devices. Many specific details of certain embodiments of the invention are set forth in the following description, and in FIGS. 2–8, to provide a thorough understanding of the embodiments described herein. One skilled in the art, however, will understand that the present invention may have additional embodiments, or that the invention may be practiced without several of the details described in the following description.

Figure 2:
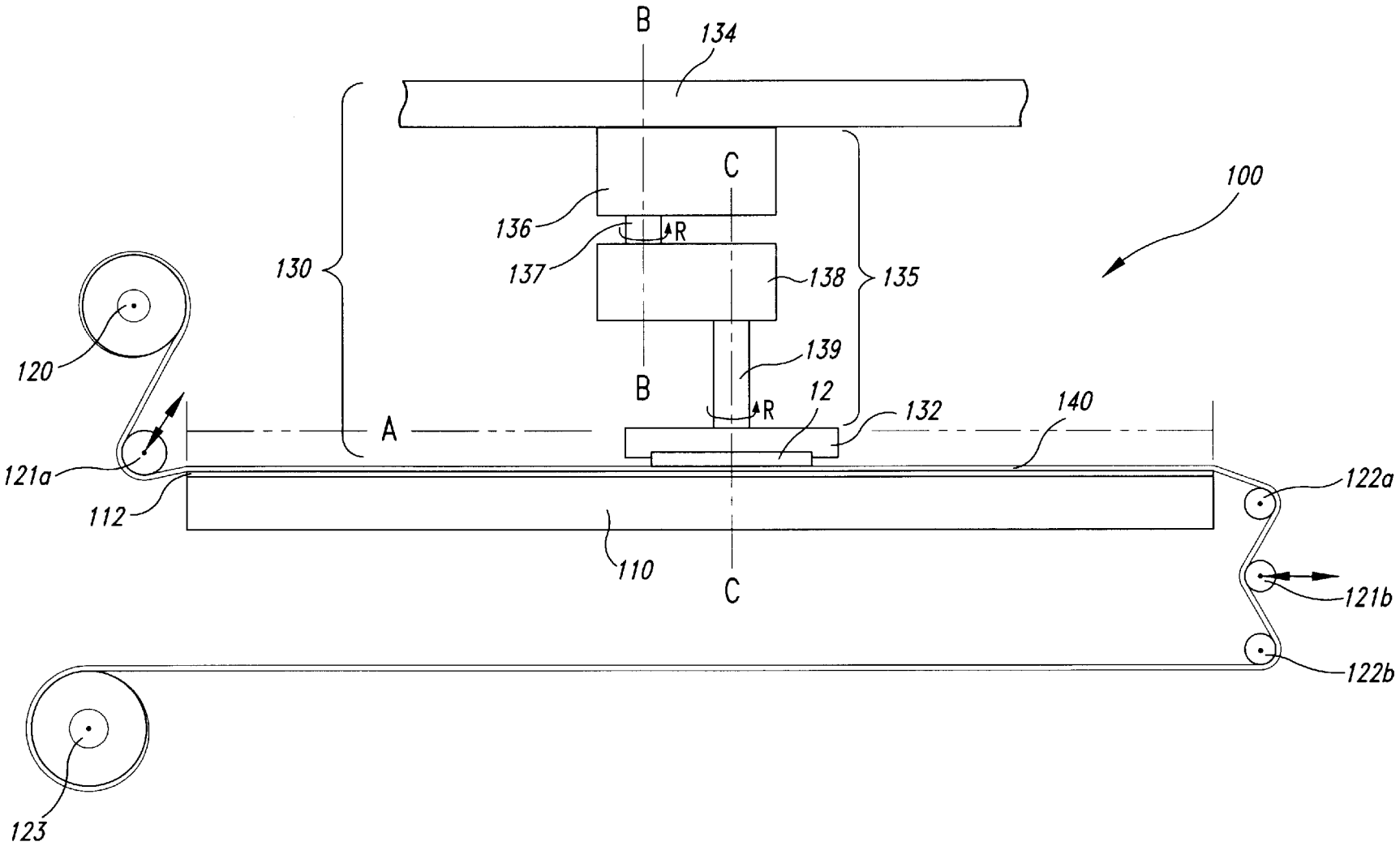
FIG. 2 is a schematic cross-sectional view of another planarizing machine with a polishing pad in accordance with one embodiment of the invention.

FIG. 2 is a schematic side elevational view of a planarizing machine 100 and a polishing pad 140 in accordance with one embodiment of the invention for planarizing a substrate 12. The features and advantages of the polishing pad 140 are best understood in the context of the structure and the operation of the planarizing machine 100. Thus, the general features of the planarizing machine 100 will be described initially.

The planarizing machine 100 is a web-format planarizing machine with a support table 110 having a top-panel 112 at a workstation where an operative portion "A" of the polishing pad 140 is positioned. The top-panel 112 is generally a rigid plate to provide a flat, solid surface to which a particular section of the polishing pad 140 may be secured during planarization. The planarizing machine 100 also has a plurality of rollers to guide, position and hold the polishing pad 140 over the top-panel 112. In one embodiment, the rollers include a supply roller 120, first and second idler rollers 121*a* and 121*b*, first and second guide rollers 122*a* and 122*b*, and a take-up roller 123. The supply roller 120 carries an unused or pre-operative portion of the polishing pad 140, and the take-up roller 123 carries a used or post-operative portion of the polishing pad 140. Additionally, the first idler roller 121*a* and the first guide roller 122*a* stretch the polishing pad 140 over the top-panel 112 to hold the polishing pad 140 stationary during operation. A motor (not shown) drives at least one of the supply roller 120 and the take-up roller 123 to sequentially advance the polishing pad 140 across the top-panel 112. As such, clean pre-operative sections of the polishing pad 140 may be quickly substituted for worn sections to provide a consistent surface for planarizing and/or cleaning the substrate 12.

The planarizing machine 100 also has a carrier assembly 130 to translate the substrate 12 across the polishing pad 140. In one embodiment, the carrier assembly 130 has a substrate holder 132 to pick up, hold and release the substrate 12 at appropriate stages of the planarizing and finishing cycles. The carrier assembly 130 may also have a support gantry 134 carrying a drive assembly 135 that translates along the gantry 134. The drive assembly 135 generally has an actuator 136, a drive shaft 137 coupled to the actuator 136, and an arm 138 projecting from the drive shaft 137. The arm 138 carries the substrate holder 132 via another shaft 139. In another embodiment, the drive assembly 135 can also have another actuator (not shown) to rotate the shaft 139 and the substrate holder 132 about an axis C-C as the actuator 136 orbits the substrate holder 132 about the axis B-B. One suitable planarizing machine without the polishing pad 140 is manufactured by Obsidian, Inc. In light of the embodiments of the planarizing machine 100 described above, a specific embodiment of the polishing pad 140 will now be described in more detail.

Figure 3:
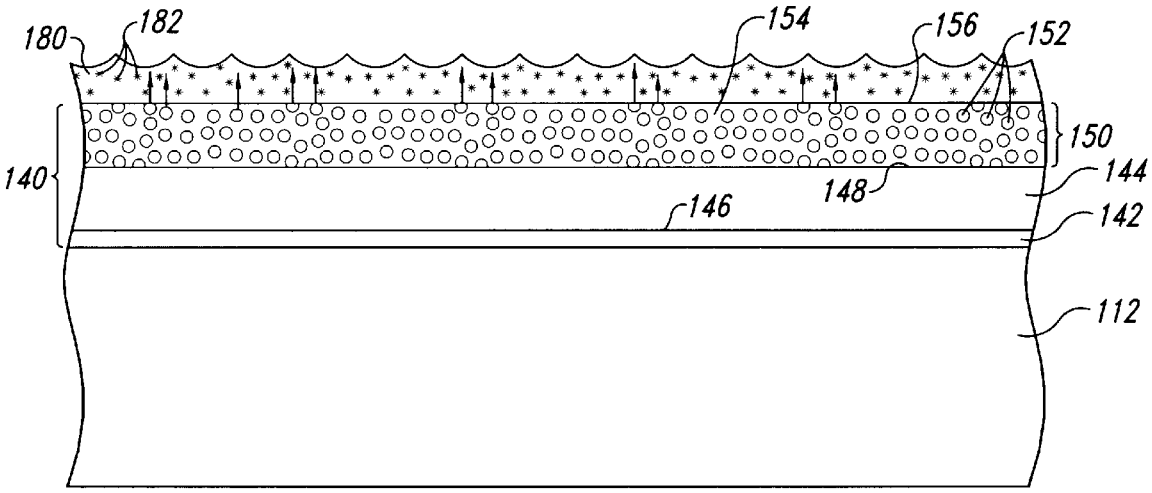
FIG. 3 is a detailed schematic cross-sectional view partially illustrating a polishing pad in accordance with one embodiment of the invention.

FIG. 3 is a detailed schematic cross-sectional view partially illustrating the polishing pad 140 according to one embodiment of the invention positioned over the top-panel 112 of the planarizing machine 100 (FIG. 2). In this embodiment, the polishing pad 140 has a backing film 142, a body 144 attached to the backing film 142, and a planarizing control member 150 attached to the body 144. The backing film 142 is generally a flexible sheet that can wrap around the rollers of the planarizing machine 100. The backing film 142 also generally has a high tensile strength to withstand the tensile forces exerted on the polishing pad 140 as an operative section of the polishing pad 140 is stretched over the top-panel 112. One suitable material for the backing film 142 is Mylar® manufactured by E.I. Du Pont de Nemours of Wilmington, Del.

The body 144 of the polishing pad 140 has a backing surface 146 and a front surface 148 opposite the backing surface 146. The backing surface 146 is configured to be attached to the backing film 142, and the front surface 148 is preferably a highly planar surface facing away from the top-panel 112 to provide a surface for the planarizing control member 150. The body 144 is generally composed of a continuous phase matrix material, such as polyurethane, or other suitable polishing pad materials. In general, the body 144 is designed to provide the desired compressibility/rigidity to the polishing pad 140.

The planarizing control member 150 includes a plurality of reaction control elements 152 dispersed within a suspension medium 154 or a suspension section. The reaction control elements 152 are preferably soluble in a planarizing fluid 180 to add a chemical or other component to the planarizing fluid 180. The reaction control elements 152, more particularly, are preferably composed of materials that impart a planarizing property to the planarizing fluid for selectively controlling interaction between the planarizing fluid and a microelectronic-device substrate assembly. For example, the reaction control elements can be compounds composed of, at least in part, one or more of the following types of materials: (1) oxidizers selected to oxidize metals or other materials at the surface of the substrate assembly; (2) inhibitors to inhibit removal of selected materials at the surface of the substrate assembly; (3) surfactants to improve the wetting characteristic of the planarizing fluid on the substrate assembly; (4) viscosity agents to increase or decrease the viscosity of the planarizing fluid; (5) buffering agents; (6) thickeners; and/or (7) other components used in slurries. The reaction control elements 152 can accordingly be compounds that impart a chemical or another component to the planarizing fluid to control a property of the planarizing fluid during planarization.

The suspension medium 154 of the planarizing control member 150 is preferably a binder that fixedly holds the reaction control elements 152 in a desired distribution and adheres the planarizing control member 150 to the front surface 148 of the pad body 144. One suitable binder, for example, is a typical resin used in fixed-abrasive polishing pads. The reaction control elements 152 are accordingly fixedly attached to the body 144 to provide a planarizing surface 156 with a fixed distribution of reaction control elements 152. The control member 150 with the reaction control elements 152 and the suspension medium 154 can be formed in accordance with the processes known in the art.

The polishing pad 140 is particularly well suited for planarizing a metal layer from a substrate assembly in the fabrication of contacts and damascene interconnect lines. In metal CMP, it is generally desirable to oxidize the metal surface without dissolving the metal in the planarizing solution because the abrasive particles in the slurry or the polishing pad can more easily remove the oxidized surface of the metal layer. For example, the reaction control elements 152 can be solid oxidizing agents composed of: (1) potassium permanganate ($K_2MnO_4$); (2) hydrolyzed ferric nitrate ($Fe(NO_3)_2.6H_2O$); (3) potassium nitrate ($KNO_3$); (4) potassium iodate ($KIO_3$); (5) ammonium persulfate; (6) Ammonium Molybdate; and/or (7) oxalic acid. When the reaction control elements 152 are an oxidizing agent, the concentration of the oxidizing agent in the suspension medium 154 is generally between 0.5–5.0 $Kg/cm^3$. The concentration of the oxidizing agent is a function of the solubility rate of the oxidizing agent in the particular planarizing fluid and the desired concentration of the dissolved oxidizing agent in the planarizing fluid. Accordingly, the concentration of the oxidizing agent in the suspension medium 154 is selected to provide the desired concentration of oxidizing agent in a planarizing fluid for each particular application of the CMP process.

In another particular embodiment of the polishing pad 140, the reaction control elements are inhibiting agents selected to stop chemical removal of one or more materials exposed at the surface of the substrate assembly. For example, benzoltriazole (BTA) particles can be embedded into a suspension medium 154 composed of a resin to stop chemical removal of silicon dioxide dielectric layers at the surface of a substrate. As explained above with respect to the oxidizing agents, the concentration of inhibiting agents in the suspension medium 154 is a function of the solubility rate of the inhibiting agents in the planarizing fluid and the desired concentration of the dissolved inhibiting agents in the planarizing fluid.

As set forth above, the reaction control elements 152 can be surfactants, buffers and/or thickeners. Suitable surfactants include polyethylene glycol, polyoxy ethylene ether or polypropylene glycol. Suitable buffers include ammonium acetate, ammonium citrate, ammonium phosphate and/or potassium hydrogen phthalate. Suitable thickeners include polyox and/or carbopol.

Figure 4:
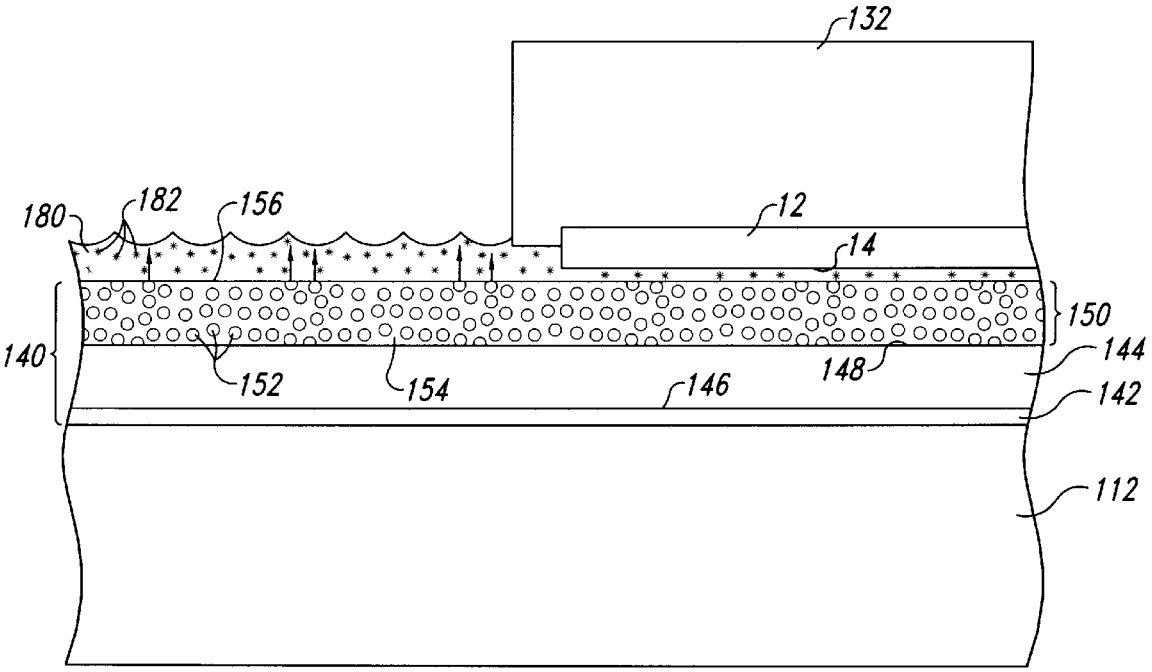
FIG. 4 is a detailed schematic cross-sectional view partially illustrating a microelectronic-device substrate assembly being planarized on the polishing pad of FIG. 3.

FIG. 4 is a schematic cross-sectional view partially illustrating a substrate assembly 12 being planarized on the polishing pad 140 in one embodiment of a CMP process in accordance with the invention. The substrate holder 132 presses a front face 14 of the substrate 12 against the planarizing surface 156 of the polishing pad 140 in the presence of the planarizing fluid 180. During planarization, the reaction control elements 152 at the planarizing surface 156 dissolve into the planarizing fluid 180. As stated above, the reaction control elements 152 impart a planarizing property to the planarizing fluid 180 for selectively controlling an aspect of the interaction between the planarizing fluid 180 and the front face 14 of the substrate 12. In this particular embodiment, the planarizing fluid 180 also contains a plurality of abrasive particles 182, such as ceria particles, alumina particles, silicon dioxide particles, titania particles or other suitable particles. Accordingly, as the substrate holder 132 moves the substrate 12 across the planarizing surface 156 of the polishing pad 140, the portion of the reaction control elements 152 dissolved in the planarizing fluid 180 cause the planarizing fluid 180 to interact with the front face 14 of the substrate 12 in a desired manner (e.g., oxidize the surface layer, inhibit chemical removal of material at the substrate surface, and/or enhance the wetting characteristics of the planarizing fluid on the substrate 12). The dissolved portion of the reaction control elements 152 and the abrasive particles 182 accordingly act together to remove material from the front face 14 of the substrate 12.

The embodiment of the polishing pad 140 illustrated in FIGS. 3 and 4 is expected to provide good control of the interaction between the planarizing fluid 180 and the substrate 12. For example, compared to planarizing substrates with conventional polishing pads that do not have reaction control elements and require slurries with oxidizers, inhibitors, and other chemicals, the polishing pad 140 removes many variables from CMP processing that can affect the uniformity and consistency of the polishing rate. More particularly, conventional planarizing solutions and slurries may not produce consistent polishing rates because the chemicals degrade over time causing the same slurry to have inconsistent concentrations of certain important chemicals from one planarizing cycle to another. One aspect of the polishing pad 140 is that it provides a fixed distribution of oxidizers, surfactants, inhibitors and/or other chemicals that can be imparted to the planarizing fluid from the polishing pad during planarization. The reaction control elements 152 are accordingly protected from deterioration by the suspension medium 154 until being exposed to a planarizing solution. Moreover, the distribution or concentration of the dissolved portion of the reaction control elements with respect to the wafer is easily maintained and controlled because the reaction control elements are fixedly attached to the suspension medium in a desired distribution. Thus, the polishing pad 140 provides a consistent concentration of active chemicals in the planarizing fluid to accurately control the polishing rate of the water.

Figure 5:
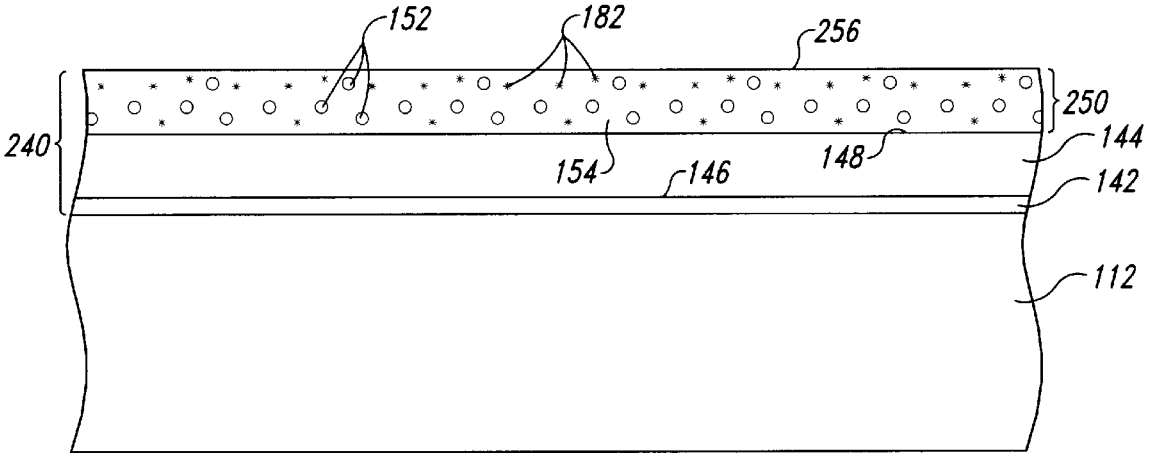
FIG. 5 is a detailed schematic cross-sectional view partially illustrating another polishing pad in accordance with another embodiment of the invention.

FIG. 5 is a detailed schematic cross-sectional view partially illustrating a polishing pad 240 in accordance with another embodiment of the invention. In this embodiment, the polishing pad 240 has the backing film 142, the pad body 144, and a planarizing control member 250 with a first plurality of reaction control elements 152 and a second plurality of abrasive particles 182. The reaction control elements 152 and the abrasive particles 182 are preferably fixedly attached to a suspension medium 154. The planarizing control member 250 is attached to the front surface of the pad body 144, and the planarizing control member 250 has an abrasive planarizing surface 256. The control elements 152 can be the same as set forth above with respect to FIGS. 3 and 4. The abrasive particles 182 can be alumina particles, cerium oxide particles, tantalum oxide particles, silicon dioxide particles, titanium dioxide or other suitable abrasive particles for planarizing substrate assemblies. Additionally, the abrasive particles 182 have particles sizes of approximately 5 Å–10,000 Å, and preferably between 100 Å–5,000 Å. The operation of the polishing pad 240 is similar to the polishing pad 140, except that the abrasive particles 182 are fixedly distributed across the planarizing surface 256 to provide a desired level of abrasiveness across the face of the substrate.

Figure 6:
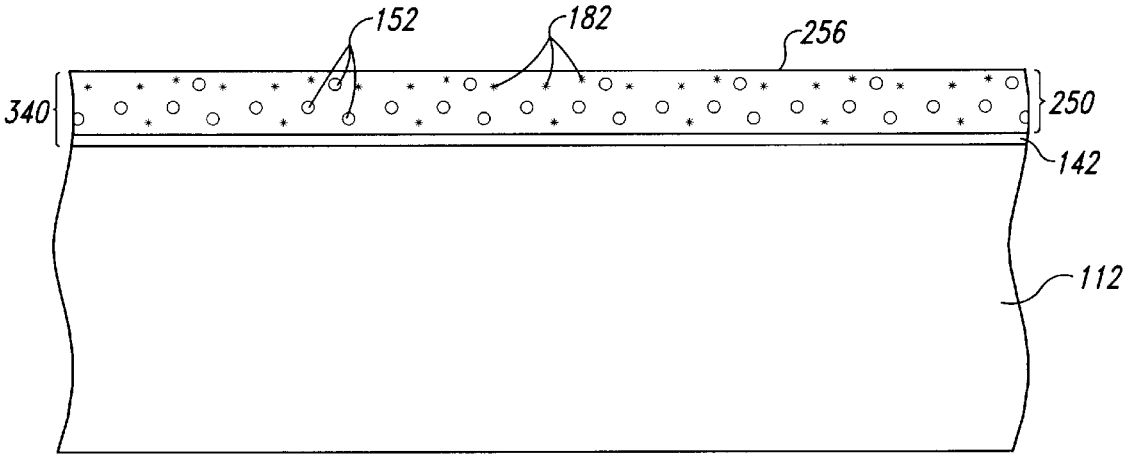
FIG. 6 is a detailed schematic cross-sectional view partially illustrating yet another polishing pad in accordance with yet another embodiment of the invention.

FIG. 6 is a detailed schematic cross-sectional view partially illustrating a polishing pad 340 in accordance with yet another embodiment of the invention. In this embodiment, the polishing pad 340 has the backing film 142 and the abrasive planarizing control member 250 is attached directly to the backing film 142. The polishing pad 340 illustrated in FIG. 6 is particularly well suited for applications that require a hard, substantially incompressible polishing pad because the backing film 142 and the planarizing control member 250 can be composed of substantially incompressible materials. On the other hand, the polishing pad 140 in FIG. 3 and the polishing pad 240 in FIG. 5 are typically well suited for applications that require more compressible polishing pads because the pad body 144 (FIGS. 3–5) can be composed of a more compressible material.

Figure 7:
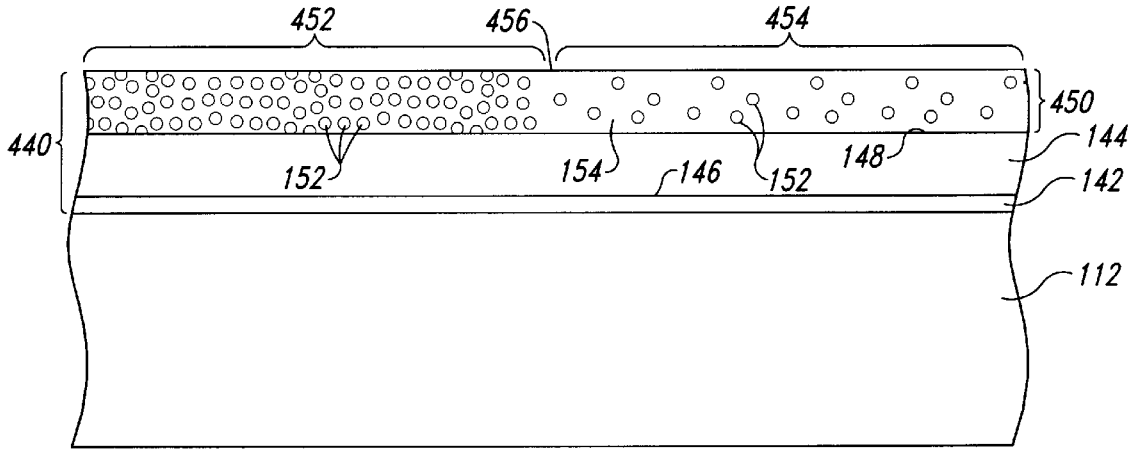
FIG. 7 is a detailed schematic cross-sectional view partially illustrating still another polishing pad in accordance with another embodiment of the invention.

FIG. 7 is a detailed schematic cross-sectional view of a polishing pad 440 in accordance with still another embodiment of the invention. In this embodiment, the polishing pad 440 has the backing film 142, the pad body 144 attached to the backing film 142, and a planarizing control member 450 attached to the front face 148 of the pad body 144. The planarizing control member 450 has a first region 452 with a first distribution of reaction control elements 152, and a second region 454 with a second distribution of the reaction control elements 152. As shown in FIG. 7, for example, the first region 452 has a higher density of the reaction control elements 152 than the second region 454. The particular densities of the reaction control elements 152 in the discrete regions of the planarizing control member 450 are generally selected to provide a desired variation in the concentration of the reaction control elements in the planarizing fluid (not shown). For example, the distribution of the reaction control elements 152 can be selected to compensate for known discrepancies in the polishing rate across areas of the polishing pad 440. Accordingly, the desired concentration of reaction control elements 152 in the planarizing member 450 is not necessarily a uniform distribution, but rather the distribution that results in the desired concentration of chemicals in the planarizing fluid relative to the location on the polishing pad.

Figure 8:
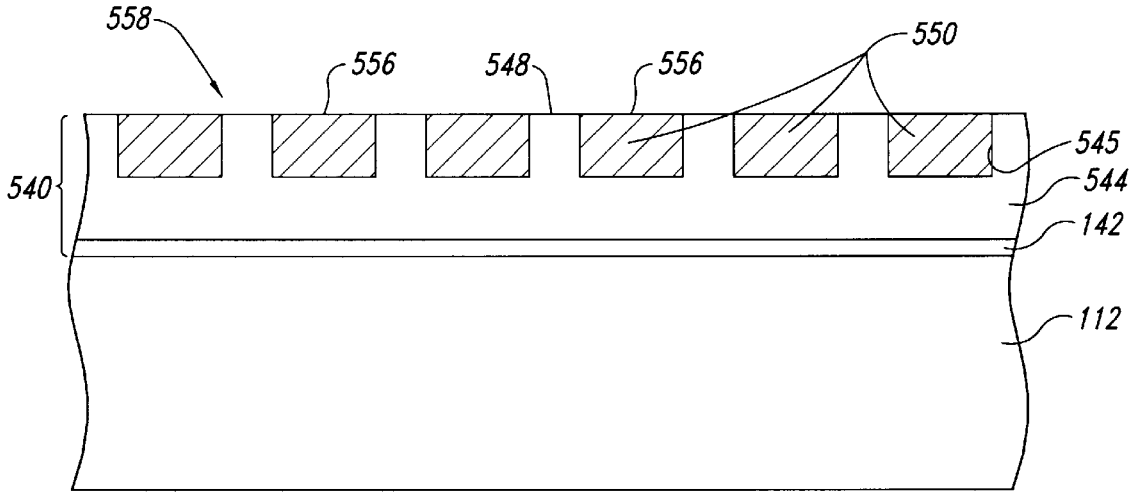
FIG. 8 is a detailed schematic cross-sectional view partially illustrating another polishing pad in accordance with another embodiment of the invention.

FIG. 8 is a detailed schematic cross-sectional view partially illustrating a polishing pad 540 in accordance with yet another embodiment of the invention. In this embodiment, the polishing pad 540 has the backing film 142, a pad body 544, and a plurality of planarizing control members 550 embedded in the pad body 544. The pad body 544 preferably has a plurality of wells 545 that are open at a front face 548 of the pad body 544. The planarizing control members 550 are positioned in the wells 545 such that a top surface 556 of the planarizing control members 550 and the front surface 548 of the pad body 544 define a planarizing surface 558 of the polishing pad 540. The planarizing control members 550 may have a plurality of reaction control elements (not shown) as set forth above with reference to the planarizing control member 150 of the polishing pad 140 (FIG. 3). The planarizing control members 550 can also include a plurality of abrasive particles as set forth above with reference to the planarizing control member 250 (FIG. 6). Additionally, the wells 545 can be arranged in a pattern across the pad body 544 to provide a desired surface ratio at the planarizing surface between the top surface 556 of the planarizing control members 550 and the front surface 548 of the pad body 544. Several patterns of wells without the planarizing control members 550 are disclosed in U.S. Pat. Nos. 5,020,283; 5,232,875; and 5,297,364, which are all herein incorporated by reference.

Figure 9:
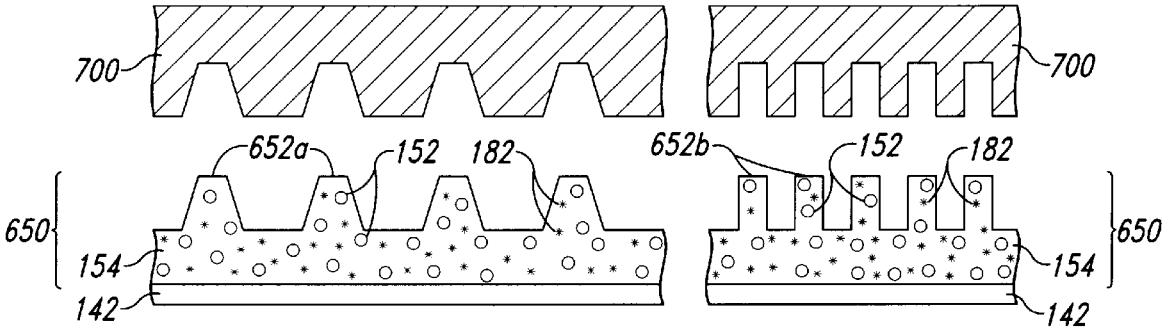
FIG. 9 is a detailed schematic cross-sectional view partially illustrating another polishing pad in accordance with another embodiment of the invention.

FIG. 9 is a detailed schematic cross-sectional view partially illustrating another polishing pad 640 in accordance with still another embodiment of the invention. In this embodiment, the polishing pad 640 has the backing film 142 and a planarizing control member 650 having a patterned planarizing surface. More particularly, the planarizing control member 650 has a plurality of raised features 652 (identified by reference numbers 652*a* and 652*b*). The raised features 652 can have a truncated pyramidal shape, such as the raised features identified by reference number 652*a*, or a columnar shape, such as the raised features identified by reference number 652*b*. The raised features 652 can also have other shapes, and a single pad 640 can have raised features of different shapes, sizes and arrangements. The raised features 652 include a plurality of planarizing control elements 152 distributed in a suspension medium 154, and more preferably the raised features 652 also include a plurality of abrasive particles 182 distributed in the suspension medium 154.

The raised features 652 are preferably formed by embossing or pressing a mold 700 against the planarizing control member 650 before the suspension medium 154 cures. For example, when the suspension medium 154 is a thermosetting resin, the mold 700 can be pressed against the suspension medium 154 while the resin is in a flowable state. The raised features 652 can also be formed by photo-patterning the planarizing control member 650 and etching the raised features 652. The base portion of the raised features 652, therefore, can extend all the way to the backing film 142.

The various embodiments of planarizing pads illustrated in FIGS. 2–9 can also be combined to develop even more embodiments of pads in accordance with the invention. The planarizing pads not only can have different types of reaction control elements in a single pad, but the size, concentration, distribution, shape and other features of the reaction control elements can be varied across the planarizing surface of a pad to control the center-to-edge planarizing profile the arises in many CMP applications. For example, a first region of the pad can have a first type of oxidizing agent and a second region of the pad can have a second type of oxidizing agent. This type of variation across the surface of the pad can also be used with other types of planarizing control elements. Another example, is to vary the density of reaction control elements across the pad (FIG. 7), and/or vary the size and shape of the raised features across the pad (FIG. 9). Thus, planarizing pads in accordance with the invention can have several different embodiments.

Figure 1:
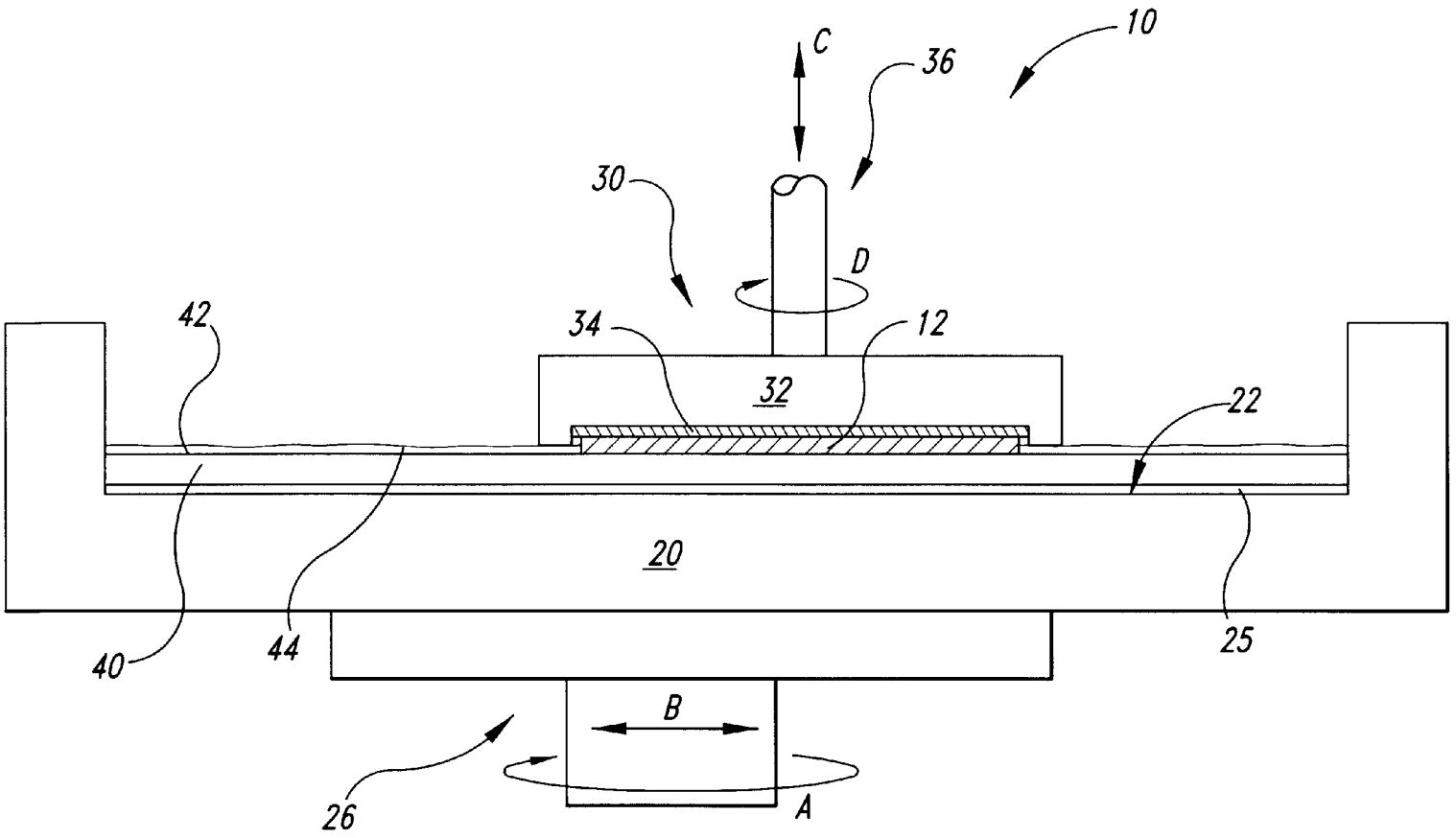
Fig. 1 (Prior Art)
FIG. 1 is a schematic cross-sectional view of a planarizing machine in accordance with the prior art.

From the foregoing it will be appreciated that, although specific embodiments of the invention have been described herein for purposes of illustration, various modifications may be made without deviating from the spirit and scope of the invention. For example, although the embodiments of the polishing pads illustrated in FIGS. 3–8 include a backing film 142, other embodiments of polishing pads in accordance with the invention do not include a backing film. The embodiments of the polishing pads shown in FIGS. 3–8 include the backing film 142 because they are well suited for use with the web-format planarizing machine 100 shown in FIG. 2. Other embodiments of the polishing pads without the backing film are generally useful for use with rotating platen planarizing machines similar to the planarizing machine 10 shown in FIG. 1. Additionally, depending upon the particular CMP application, a planarizing fluid with or without abrasive particles may be used on a polishing pad with or without abrasive particles. Accordingly, the invention is not limited except as by the appended claims.

What is claimed is:

1. A polishing pad for mechanical or chemical-mechanical planarization of microelectronic-device substrate assemblies in the presence of a planarizing fluid, comprising:

a suspension medium having an exposed surface configured to face toward a substrate assembly during planarization; and a plurality of reaction control elements in the suspension medium arranged in a fixed distribution across at least the exposed surface of the suspension medium to define at least a portion of a planarizing surface of the pad, the reaction control elements being soluble in the planarizing fluid to impart a chemical to the planarizing fluid that interacts with the substrate assembly.

2. The polishing pad of claim 1 wherein the reaction control elements comprise an oxidant selected to oxidize a material on the substrate assembly.

3. The polishing pad of claim 2 wherein the oxidant comprises at least one oxidant selected from the group consisting of potassium permanganate, hydrolyzed ferric nitrate, potassium nitrate, potassium iodate, ammonium persulfate, ammonium molybdate and oxalic acid.

4. The polishing pad of claim 1 wherein the reaction control elements further comprise an inhibitor.

5. The polishing pad of claim 4 wherein the inhibitor comprises at least one of benzoltriazole, mercaptobenzothiazole, sodium silicate, ammonium borate, ammonium phosphate, tolytriazole, imidazole or potassium dichromate.

6. The polishing pad of claim 1, further comprising a plurality of abrasive particles bonded to the suspension medium.

7. The polishing pad of claim 6 wherein the abrasive particles comprise at least one abrasive material selected from the group consisting of an aluminum oxide, a cerium oxide, a tantalum oxide, titanium dioxide and a silicon dioxide.

8. The polishing pad of claim 7 wherein the reaction control elements comprise an oxidant.

9. The polishing pad of claim 8 wherein the oxidant comprises at least one oxidant selected from the group consisting of potassium permanganate, hydrolyzed ferric nitrate, potassium nitrate, potassium iodate, ammonium persulfate, ammonium molybdate and oxalic acid.

10. The polishing pad of claim 9 wherein the reaction control elements further comprise an inhibitor.

11. The polishing pad of claim 10 wherein the inhibitor comprises at least one of benzoltriazole, mercaptobenzothiazole, sodium silicate, ammonium borate, ammonium phosphate or potassium dichromate.

12. The polishing pad of claim 1, further comprising a backing film, the suspension medium being attached directly to the backing film.

13. The polishing pad of claim 1, further comprising a pad body, the suspension medium being attached to the pad body.

14. The polishing pad of claim 13 wherein:

the pad body has a backing surface configured to face toward a table of a planarizing machine and a front surface configured to face toward the substrate assembly; and the suspension medium is attached to the front surface of the pad body to cover the front surface of the pad body.

15. The polishing pad of claim 13, further comprising a backing film attached to the backing surface of the pad body.

16. The polishing pad of claim 13 wherein:

the pad body has a backing surface configured to face toward a table of a planarizing machine and a front surface configured to face toward the substrate assembly; and the suspension medium is embedded into the pad body, the exposed surface of the suspension medium and the front surface of the pad body being coplanar to define the planarizing surface of the polishing pad.

17. The polishing pad of claim 16, further comprising a backing film attached to the backing surface of the pad body.

18. The polishing pad of claim 1, further comprising:

a backing film;

a pad body having a backing surface attached to the backing film and a front surface opposite the backing surface, the suspension medium being attached to the pad body; and a plurality of abrasive particles fixedly attached to the suspension medium.

19. The polishing pad of claim 18 wherein:

the pad body comprises polyurethane;

the reaction control elements comprise at least one oxidant selected from the group consisting of potassium permanganate, hydrolyzed ferric nitrate, potassium nitrate, potassium iodate, ammonium persulfate, ammonium molybdate, and oxalic acid; and the abrasive particles comprise at least one abrasive material selected from the group consisting of an aluminum oxide, a cerium oxide, a tantalum oxide, titanium dioxide and a silicon dioxide.

20. The polishing pad of claim 1, the pad further comprises a backing film to which the suspension is attached, and wherein the suspension medium has a pattern of raised features projecting away from the backing film.

21. The polishing pad of claim 20, further comprising a plurality of abrasive particles attached to the suspension medium.

22. The polishing pad of claim 20 wherein a plurality of first raised features have a first shape and a plurality of second raised features have a second shape.

23. The polishing pad of claim 1 wherein the reaction control elements comprise a first plurality of a first type of reaction control elements and a second plurality of a second type of reaction control elements.

24. The polishing pad of claim 23 wherein the first type of reaction control elements are located in a first region and a second type of reaction control elements are located in a second region.

25. The polishing pad of claim 1 wherein the reaction control elements comprise a buffer.

26. The polishing pad of claim 25 wherein the buffer comprises at least one compound selected from the group consisting of ammonium acetate, ammonium citrate, ammonium phosphate and potassium hydrogen phthalate.

27. The polishing pad of claim 1 wherein the reaction control elements comprise a surfactant.

28. The polishing pad of claim 27 wherein the surfactant comprises at least one compound selected from the group consisting of polyethylene glycol, polyoxy ethylene ether and polypropylene glycol.

29. The polishing pad of claim 1 wherein the reaction control elements comprises a thickener.

30. The polishing pad of claim 29 wherein the thickener comprises a compound selected from the group consisting of polyox, polyethylene glycol and carbopol.

31. A polishing pad for mechanical or chemical-mechanical planarization of microelectronic-device substrate assemblies in the presence of a planarizing fluid, comprising:

a body having a backing surface configured to be placed over a table of a planarizing machine and a front surface opposite the backing surface configured to face away from the table; and a plurality of reaction control elements, the reaction control elements being soluble in the planarizing fluid to impart a planarizing property to the planarizing fluid for selectively controlling interaction between the planarizing fluid and the substrate assembly, and at least a portion of the reaction control elements being distributed along at least the front surface of the body to define a planarizing surface with a fixed distribution of reaction control elements.

32. The polishing pad of claim 31, further comprising a suspension medium attached to the body, the reaction control elements being bonded to the suspension medium to define a planarizing control member separate from the body.

33. The polishing pad of claim 32, further comprising a plurality of abrasive particles fixedly attached to the planarizing control member.

34. The polishing pad of claim 33 wherein the reaction control elements comprise an oxidant selected to oxidize a material on the substrate assembly.

35. The polishing pad of claim 34 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

36. The polishing pad of claim 35 wherein the reaction control elements further comprise an inhibitor.

37. A polishing pad for mechanical and chemical-mechanical planarization of microelectronic-device substrate assemblies in the presence of a planarizing fluid, comprising:

a body having a backing surface configured to be placed over a table of a planarizing machine and a front surface opposite the backing surface configured to face away from the table;

a suspension medium attached to the body, the suspension medium having an exposed surface configured to face toward a substrate assembly to define at least a portion of a planarizing surface;

a plurality of abrasive particles, at least a portion of the abrasive particles being fixedly attached to the suspension medium to define a fixed distribution of abrasive particles at the planarizing surface; and a plurality of reaction control elements separate from the abrasive particles, the reaction control elements being soluble in a planarizing fluid to impart a planarizing property to the planarizing fluid for selectively controlling interaction between the planarizing fluid and the substrate assembly, and the reaction control elements being fixedly attached to the suspension medium to provide a fixed distribution of reaction control elements at the planarizing surface of the polishing pad.

38. The polishing pad of claim 37 wherein the reaction control elements comprise an oxidant selected to oxidize a material on the substrate assembly.

39. The polishing pad of claim 38 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

40. The polishing pad of claim 39 wherein the abrasive particles comprise at least one abrasive material selected from the group consisting of an aluminum oxide, a cerium oxide, a tantalum oxide, titanium oxide and a silicon dioxide.

41. A polishing pad for mechanical and chemical-mechanical planarization of microelectronic-device substrate assemblies in the presence of a planarizing fluid, comprising:

a body having a backing surface and a front surface opposite the backing surface; and a planarizing control member attached to the body at least proximate to the front surface such that at least a portion of the planarizing control member defines a planarizing surface of the polishing pad, the planarizing control member including a plurality of reaction control elements and a binder to fix the reaction control elements to the body, the reaction control elements being soluble in the planarizing fluid to impart a planarizing property to the planarizing fluid for selectively controlling interaction between the planarizing fluid and the substrate assembly.

42. The polishing pad of claim 41 wherein the reaction control elements comprise an oxidant selected to oxidize a material on the substrate assembly.

43. The polishing pad of claim 42 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

44. The polishing pad of claim 42 wherein the reaction control elements further comprise an inhibitor.

45. The polishing pad of claim 44 wherein the inhibitor comprises at least one of benzoltriazole, mercaptobenzothiazole, sodium silicate, ammonium borate, ammonium phosphate or potassium dichromate.

46. The polishing pad of claim 41, further comprising a plurality of abrasive particles bonded to the binder.

47. The polishing pad of claim 46 wherein the abrasive particles comprise at least one abrasive material selected from the group consisting of an aluminum oxide, a cerium oxide, a tantalum oxide, titanium oxide and a silicon dioxide.

48. The polishing pad of claim 47 wherein the reaction control elements comprise an oxidant.

49. The polishing pad of claim 48 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

50. The polishing pad of claim 41 wherein the planarizing control member covers the front surface of the body.

51. The polishing pad of claim 41 wherein the planarizing control member is embedded into the body, the planarizing control member having an exposed surface coplanar with the front surface of the body to define the planarizing surface of the polishing pad.

52. A planarizing machine for mechanical and chemical-mechanical planarization of microelectronic-device substrate assemblies in the presence of a planarizing fluid, comprising:

a table;

a carrier assembly having a substrate holder to which a substrate assembly can be attached; and a polishing pad including a body and a plurality of reaction control elements, the body having a backing surface configured to be placed over the table of a planarizing machine and a front surface opposite the backing surface configured to face away from the table, the reaction control elements being soluble in the planarizing fluid to impart a planarizing property to the planarizing fluid for selectively controlling interaction between the planarizing fluid and the substrate assembly, and at least a portion of the reaction control elements being distributed along at least the front surface of the body to define a planarizing surface with a fixed distribution of reaction control elements.

53. The planarizing machine of claim 52, further comprising a suspension medium attached to the body, the reaction control elements being bonded to the suspension medium to define a planarizing control member separate from the body.

54. The planarizing machine of claim 53, further comprising a plurality of abrasive particles fixedly attached to the planarizing control member.

55. The planarizing machine of claim 52 wherein the reaction control elements comprise an oxidant selected to oxidize a material on the substrate assembly.

56. The planarizing machine of claim 55 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

57. The planarizing machine of claim 56 wherein the reaction control elements further comprise an inhibitor.

58. A planarizing machine for mechanical and chemical-mechanical planarization of microelectronic-device substrate assemblies in the presence of a planarizing fluid, comprising:

a table;

a carrier assembly having a substrate holder to which a substrate assembly can be attached; and a polishing pad having a suspension medium and a planarizing agent, the suspension medium having an exposed surface configured to face toward the substrate holder, the planarizing agent being arranged in the suspension medium in a fixed distribution across at least the exposed surface of the suspension medium to define at least a portion of a planarizing surface of the pad, the planarizing agent being soluble in the planarizing fluid to impart a chemical to the planarizing fluid that interacts with the substrate assembly for controlling removal of material from the substrate assembly.

59. The planarizing machine of claim 58 wherein the planarizing agent comprises an oxidant selected to oxidize a material on the substrate assembly.

60. The planarizing machine of claim 59 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

61. The planarizing machine of claim 59 wherein the planarizing agent further comprises an inhibitor.

62. The planarizing machine of claim 61 wherein the inhibitor comprises at least one of benzoltriazole, mercaptobenzothiazole, sodium silicate, ammonium borate, ammonium phosphate or potassium dichromate.

63. The planarizing machine of claim 58, further comprising a plurality of abrasive particles bonded to the suspension medium.

64. The planarizing machine of claim 63 wherein the abrasive particles comprise at least one abrasive material selected from the group consisting of an aluminum oxide, a cerium oxide, a tantalum oxide, titanium oxide and a silicon dioxide.

65. The planarizing machine of claim 64 wherein the planarizing agent comprises an oxidant.

66. The planarizing machine of claim 65 wherein the oxidant comprises at least one oxidant selected from the group consisting of potassium permanganate, hydrolyzed ferric nitrate, potassium nitrate, potassium iodate, ammonium persulfate, ammonium molybdate, and oxalic acid.

67. The planarizing machine of claim 58, further comprising a supply roller and a take-up roller, wherein the polishing pad is a web-format pad wrapped around the supply roller.

68. A method for planarizing a microelectronic-device substrate assembly, comprising:

removing material from the substrate assembly by pressing the substrate assembly against a planarizing surface of a polishing pad in the presence of a planarizing fluid and moving at least one of the polishing pad or the substrate assembly with respect to the other; and reacting a planarizing agent fixedly attached to the polishing pad with the planarizing fluid to selectively control a property of the planarizing fluid with respect to the planarizing surface.

69. The method of claim 68, further comprising abrading the substrate assembly with a plurality of abrasive particles bonded to the polishing pad while reacting the planarizing agent with the planarizing fluid.

70. The method of claim 68 wherein reacting the planarizing agent with the planarizing fluid comprises depositing the planarizing fluid onto the planarizing surface and dissolving the planarizing agent into the planarizing fluid deposited onto the planarizing surface.

71. The method of claim 70, further comprising abrading the substrate assembly with a plurality of abrasive particles bonded to the polishing pad while reacting the planarizing agent with the planarizing fluid.

72. The method of claim 70 wherein the planarizing agent comprises an oxidant selected to oxidize a material on the substrate assembly, and wherein dissolving the planarizing agent into the planarizing fluid comprises depositing a selected planarizing solution onto the planarizing surface in which the oxidant is soluble.

73. The method of claim 72, further comprising selecting at least one oxidant selected from the group consisting of potassium permanganate, hydrolyzed ferric nitrate, potassium nitrate, potassium iodate, ammonium persulfate, ammonium molybdate, and oxalic acid.

74. The method of claim 72 wherein the substrate assembly has a metal cover layer, and wherein removing material from the metal cover layer comprises oxidizing the metal cover layer with a dissolved portion of the oxidant in the planarizing fluid.

75. A method for planarizing a microelectronic-device substrate assembly, comprising:

removing material from the substrate assembly by pressing the substrate assembly against a planarizing surface of a polishing pad in the presence of a planarizing fluid and moving at least one of the polishing pad or the substrate assembly with respect to the other; and imparting at least a portion of a reaction control element to the planarizing fluid from the planarizing surface of the polishing pad to control an aspect of the interaction between the planarizing fluid and the substrate assembly.

76. The method of claim 75, further comprising abrading the substrate assembly with a plurality of abrasive particles bonded to the polishing pad while imparting the reaction control element to the planarizing fluid.

77. The method of claim 75 wherein imparting the reaction control element to the planarizing fluid comprises depositing the planarizing fluid onto the planarizing surface and dissolving at least a portion of the reaction control element into the planarizing fluid deposited onto the planarizing surface.

78. The method of claim 77, further comprising abrading the substrate assembly with a plurality of abrasive particles bonded to the polishing pad while imparting the reaction control element to the planarizing fluid.

79. The method of claim 77 wherein the reaction control element comprises an oxidant selected to oxidize a material on the substrate assembly, and wherein dissolving the reaction control element into the planarizing fluid comprises depositing a selected planarizing solution onto the planarizing surface in which the oxidant is soluble.

80. The method of claim 79, further comprising selecting at least one oxidant selected from the group consisting of potassium permanganate, hydrolyzed ferric nitrate, potassium nitrate, potassium iodate, ammonium persulfate, ammonium molybdate, and oxalic acid.

81. The method of claim 79 wherein the substrate assembly has a metal cover layer, and wherein removing material from the metal cover layer comprises oxidizing the metal cover layer with a dissolved portion of the oxidant in the planarizing fluid without dissolving the metal cover layer in the planarizing fluid.

* * * * *